US008782992B2

(12) United States Patent
Lin et al.

(10) Patent No.: US 8,782,992 B2
(45) Date of Patent: Jul. 22, 2014

(54) ALUMINIUM ALLOY TRUSS STRUCTURE

(76) Inventors: Juan Lin, Nanning (CN); Kun Liang, Nanning (CN)

( * ) Notice: Subject to any disclaimer, the term of this patent is extended or adjusted under 35 U.S.C. 154(b) by 0 days.

(21) Appl. No.: 13/443,790

(22) Filed: Apr. 10, 2012

(65) Prior Publication Data

US 2012/0255255 A1 Oct. 11, 2012

(30) Foreign Application Priority Data

| | | |
|---|---|---|
| Apr. 11, 2011 | (CN) | 2011 1 0088373 |
| Apr. 20, 2011 | (CN) | 2011 1 0098178 |
| May 3, 2011 | (CN) | 2011 1 0112365 |
| May 19, 2011 | (CN) | 2011 1 0129530 |
| Jun. 20, 2011 | (CN) | 2011 1 0164626 |

(51) Int. Cl.
*E04B 1/18* (2006.01)
*E04B 1/19* (2006.01)

(52) U.S. Cl.
CPC ..... *E04B 1/19* (2013.01); *E04B 1/1903* (2013.01); *E04B 2001/1984* (2013.01); *E04B 2001/1933* (2013.01); *E04B 2001/1918* (2013.01); *E04B 2001/1927* (2013.01)
USPC ..... 52/636; 52/653.1

(58) Field of Classification Search
USPC ..... 52/636, 653.1, 655.1, 650
See application file for complete search history.

(56) References Cited

U.S. PATENT DOCUMENTS

| | | | | |
|---|---|---|---|---|
| 2,947,390 | A * | 8/1960 | Stollenwerk | 52/656.1 |
| 3,562,994 | A * | 2/1971 | Linsowe | 52/650.2 |
| 3,688,461 | A * | 9/1972 | Eberhard et al. | 52/653.1 |
| 3,706,169 | A * | 12/1972 | Rensch | 52/263 |
| 4,347,015 | A * | 8/1982 | Olashaw | 403/219 |
| 4,350,318 | A * | 9/1982 | Gallis | 249/40 |
| 6,516,583 | B1 * | 2/2003 | Houghton | 52/655.1 |
| 6,802,169 | B2 * | 10/2004 | Simmons | 52/648.1 |
| 7,310,920 | B2 * | 12/2007 | Hovey, Jr. | 52/655.1 |
| 8,061,108 | B2 * | 11/2011 | Tonyan et al. | 52/745.13 |
| 8,146,322 | B2 * | 4/2012 | Karns | 52/655.1 |
| 8,316,621 | B2 * | 11/2012 | Safari et al. | 52/837 |

FOREIGN PATENT DOCUMENTS

CN 200780039151.5 3/2007

* cited by examiner

*Primary Examiner* — Basil Katcheves
(74) *Attorney, Agent, or Firm* — J.C. Patents

(57) ABSTRACT

An aluminum alloy truss structure, comprising upper chord members, lower chord members, web members and all connection nodes by which the members are connected using riveting bolts, the chord members and web members being interconnected using tenons and mortise grooves that mate with each other respectively, each of the chord members being provided with a tenon plate at the end adjacent to the respective web members, each of the web members being correspondingly provided with a mortise groove at either end thereof, and the tenon plate on the chord members being implanted into the mortise groove on the web members; or, alternatively, each of the chord members being provided with a mortise groove at the end adjacent to the respective web members, each of the web members being correspondingly provided at either end thereof with a tenon that is to mate with the mortise groove.

5 Claims, 20 Drawing Sheets

ALUMINIUM ALLOY TRUSS STRUCTURE

CROSS-REFERENCE TO RELATED APPLICATION

This application claims the priority benefit of China application No. 201110088373.5, filed on Apr. 11, 2011, application No. 201110098178.0, filed on Apr. 20, 2011, application No. 201110112365.X, filed on May 3, 2011, application No. 201110129530.2, filed on May 19, 2011 and application No. 201110164626.2, filed on Jun. 20, 2011. The contents of these prior applications are hereby incorporated by reference in their entirety.

FIELD OF THE INVENTION

The present invention relates to an aluminium alloy truss structure. The truss structure of this invention involves the use of mating tenon-mortise groove connection nodes or implanted plate type body-shaped connection nodes. All the members of the truss structure are made from aluminum alloy. And all the members meeting at the connection nodes are fastened using bolts or riveting bolts.

DESCRIPTIONS OF THE RELATED ART

China Patent Application Serial No. 200780039151.6 discloses a space frame connection node arrangement which is used for a node connector useful for interconnections of plural framing members at a node in a double layer grid-type of space frame, the node connector comprising a cylindrical base portion defining a passage having an axis and which is sized and shaped for snug slidable substantially axial insertion thereinto of an elongate chord framing member of the grid and which chord framing member has an axis along its length substantially alignable with the passage axis upon said insertion, the passage being configured to substantially enclose the chord framing member and to hold the framing member axis in alignment with the passage axis upon such insertion, the node structure carrying substantially along the length of and externally of the base portion fixed plural structural elements defining at least two pairs of parallel spaced opposing substantially flat surfaces, the surfaces of each pair being spaced equidistantly from a center plane between them which is parallel to and substantially intersects the passage axis, at least one pair of holes in the base portion aligned on a line which intersects the passage axis and is normal to it, at least one pair of further holes through the elements which define each pair of parallel spaced opposing surfaces and aligned on a line which is normal to that pair of surfaces. The node connector can be secured to a chord member in its passage and to ends of other framing members by shear pins which have zero clearances in node connector holes and in holes or passages through the respective framing members. The space frame can be a movable armature for a curved solar reflector, the space frame having a V-shaped major surface. At least some of the framing members can be thin wall tubes modified to have opposing, flat-exterior wall zones along the length of each tube and in which the wall thickness is locally increased and through which shear pin holes are defined. Unfortunately, for load bearing structures in civil engineering works (especially large-span grid structures, for example), the connection node arrangement in accordance with the said application has deficiencies in that the solid portions at the bottom of the grooves are excessively thin and the shear pin holes in the groove walls have to be disposed at relatively high locations due to the constraints of connection requirements, and, consequently, there is a potential risk that these portions are susceptible to local buckling under the effects of the pressure rods in the civil engineering works. The connection nodes are structured in a way such that the tubular chord members would be under stress eccentrically. Moreover, the application of screws to connect the members would give rise to unreliable load bearing structures in civil engineering works. For ease of assembling, one would have to resort to shear pins and retaining parts which are used to fasten the members, which, however, are unsafe and unreliable for load bearing structures in civil engineering works either. Thus, the ability of the "connector" to carry the internal forces of connection nodes of load bearing structures in civil engineering works is obviously insufficient. Therefore, it is highly desirable in the art to provide a novel aluminum alloy truss structure.

SUMMARY OF THE INVENTION

The objective of this invention is to provide an aluminum alloy truss structure. The truss structure of this invention involves the use of mating tenon-mortise groove connection nodes or implanted plate type body-shaped connection nodes. All the members of the truss structure are made from aluminum alloy. And all the members meeting at the connection nodes are fastened together using bolts or riveting bolts. This invention contributes to greatly reduced own weight of buildings and a save of materials for columns and foundation that serve to support the truss structure. Moreover, this invention allows rapid assembling of members at construction site and is particularly advantageous to cut the construction costs, and can further improve the earthquake resistant performance of structures. In addition, the aluminum alloy materials almost require no maintenance throughout their service life, thereby making it possible for a project to function for more than one hundred years. The trusses can have an either large or small span, and are widely employed in civil engineering works such as large-span factory buildings, exhibition halls, stadiums and bridges etc.

The objective of this invention is achieved through the technical schemes as descried below: an aluminum alloy truss structure, comprising upper chord members, lower chord members, web members and all connection nodes by which the members are interconnected using riveting bolts; all members of the truss are made from aluminum alloy materials; the chord members and web members are interconnected using tenons and mortise grooves that mate with each other, each of the chord members being provided with a tenon plate at the end adjacent to the web members, each of the web members being correspondingly provided with a mortise groove at either end thereof, and the tenon plate on the chord members being implanted into the mortise groove on the web members; or, alternatively, each of the chord members being provided with a mortise groove at the end adjacent to the web members, each of the web members being correspondingly provided at either end thereof with a tenon to mate with the mortise groove, either end of each web member being implanted into the mortise groove in the chord member that intersects with the web member; after each tenon is implanted into the respective mortise groove, they are fastened together using bolts or riveting bolts.

An aluminum alloy truss structure, comprising plate-shaped connection node plates and chord members and web members of aluminum alloy materials respectively connecting therewith, all the aluminum alloy members of the truss each having a groove made at either end thereof, the plate-shaped connection node plate being implanted into the grooves at the respective ends of all members that intersect at a node and fastened together with the members using bolts or riveting bolts.

An aluminum alloy truss structure, comprising all body-shaped connection node bodies of the space truss and all aluminum alloy members of the space truss that are interconnected with the connection node bodies, all the aluminum alloy members of the space truss each having a groove made at either end thereof to receive an limb plate of a connection node body that is implanted into the groove, each body-shaped connection node body being provided with three limb plates, respectively referred to as U, V and W, along X, Y and Z direction of the space truss, the limb plates being respectively implanted into the grooves at the respective ends of all members that intersect at a node and fastened together with the members using bolts or riveting bolts.

An aluminum alloy truss structure, comprising chord members, web members and all connection nodes by which the members are interconnected using riveting bolts; all members of the truss are made from aluminum alloy materials; the chord members and web members are interconnected using tenons and mortise grooves that mate with each other; in particular, a tenon plate is provided at the chord member respectively along Y, Z direction of the space truss, and a mortise groove is made at either end of each of the web chamber along Y, Z direction of the space truss to mate with the tenon, the tenon plates at the chord member along Y, Z direction being implanted into the mortise grooves in the web members along Y, Z direction respectively that intersect the chord member; or, alternatively, a mortise groove is made at the chord member respectively along Y, Z direction of the space truss, and a tenon is respectively provided at either end of each of the web chamber along Y, Z direction of the space truss to mate with the tenon, the tenon at either end of each of the web member along Y, Z direction being implanted into the mortise grooves in the chord member along Y, Z direction respectively that intersects the chord members; after each tenon is implanted into the respective mortise groove, they are fastened together using bolts or riveting bolts.

An aluminum alloy truss structure, comprising all body-shaped connection node bodies of the grid structure made from aluminum alloy materials, and all chord members and web members of the grid structure made from aluminum alloy materials that meet at respective connection nodes and are interconnected with the respective connection node bodies; in response to the needs for connecting the members, each body-shaped connection node body is provided with limb plates of the connection node body respectively in positive and negative direction of X axis in XY plane to connect the truss chord members in X axis direction, or is provided with grooves to connect the truss chord members in X axis direction, and it is provided with limb plates of the connection node body respectively in positive and negative direction of Y axis in XY plane to connect the truss chord members in Y axis direction, or is provided with grooves to connect the truss chord members in Y axis direction, and is provided with limb plates or grooves at one side of the YZ plane where the web members are located to connect the truss web members, and is provided with limb plates or grooves at the other side of the YZ plane symmetrically with respect to the said side to connect the truss web members; the truss members meeting at the connection node each has a groove made at either end thereof to receive the limb plate of the connection node body to be implanted and is then fastened together with the limb plate using bolts or riveting bolts; after the ends of truss members are respectively implanted into the grooves in the connection node body directly, they are fastened together using bolts or riveting bolts.

This invention has the following advantages over the prior art:

1. The riveting bolt and implanted plate type connection nodes are characterized in that they are stressed reasonably, structured reliably and provided with complete functions, and can be fabricated, manufactured and assembled readily during construction. All these make it a novel critical technical scheme in respect of connection nodes of aluminum alloy trusses. The truss structure, including planar truss, space truss and grid truss, is stressed definitely, structured reasonably, consumes less materials and can have either a large or a small span. In light of these advantages, they are widely employed in construction engineering of stadiums, industrial buildings, and bridges. The investigation and analysis indicate that, the truss structure, including planar truss, space truss and grid truss, is an ideal structure system made from aluminum alloy materials. The configuration of the connection nodes is a critical technology for addressing the design, fabrication, construction and widespread application of the aluminum alloy truss structure. This invention provides a truss structure involving the use of riveting bolt and implanted plate type connection nodes, including planar truss, space truss and grid truss. It has effectively addressed the application of aluminum alloy materials in civil engineering works and other fields, thereby making it possible to generalize the application of aluminum alloy structures in civil engineering works field.

2. The riveting bolt and implanted plate type connection nodes of aluminum alloy truss of this invention have eliminated the drawbacks inherent in the prior-art aluminum alloy truss as follows: The welding of aluminum alloy materials is difficult, and, consequently, sets out high technical requirements on welding thereof; heat affected regions are avoidable in welded aluminum alloy, leading to reduced material strength; and the welding of aluminum alloy materials cannot be carried out at workshops conveniently and is difficult to perform at contraction site.

3. The aluminum alloy truss structure involving the use of riveting bolt or implanted plate type connection nodes as provided in this invention have made full use of the characteristics of aluminum alloy materials that they can be formed satisfactorily and fabricated easily. The members and connection nodes that are made by means of either extruding or pressing can be standardized, enabling them to be produced in large volume at workshops and assembled rapidly at construction sites. They can not only be fabricated and constructed readily, but exhibit satisfactory quality.

4. The aluminum alloy truss structure involving the use of riveting bolt or implanted rod type connection nodes as provided in this invention allows the structural design to be performed following certain procedures.

5. The aluminum alloy material is lightweight (⅓ of weight of steel material), has a high strength (the physical and mechanical performance of series 6 aluminum material approaches that of the construction steel Q235) and high corrosion resistant performance (4-6 folds that of steel material) and almost requires no maintenance during its service life. It is a renewable environment friendly construction metal. The aluminum alloy truss structure involving the use of riveting bolt or implanted rod type connection nodes as provided in this invention is made from aluminum alloy material which can greatly reduce the own weight of buildings and improve both the earthquake resistant and corrosion resistant ability of the buildings. Moreover, it almost requires no maintenance during its service life and can function for more than one hundred years, exhibiting significant comprehensive economic benefits.

BRIEF DESCRIPTION OF THE DRAWINGS

The above features and advantages, and other features and advantages, of the present invention are readily apparent from the following detailed description of the best modes for carrying out the invention when taken in connection with the accompanying drawings wherein.

DESCRIPTION OF THE PREFERRED EMBODIMENT

Embodiment 1

Figure 1:
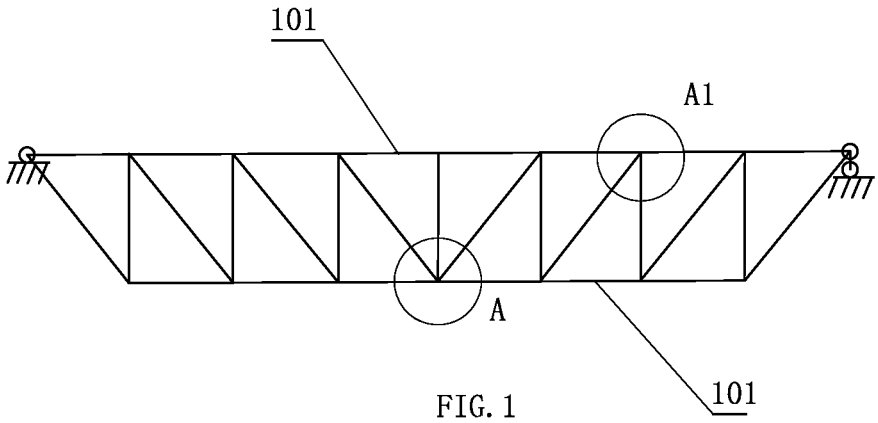
FIG. 1 is a schematic view of a first embodiment of the truss structure in accordance with this invention.
Figure 2:
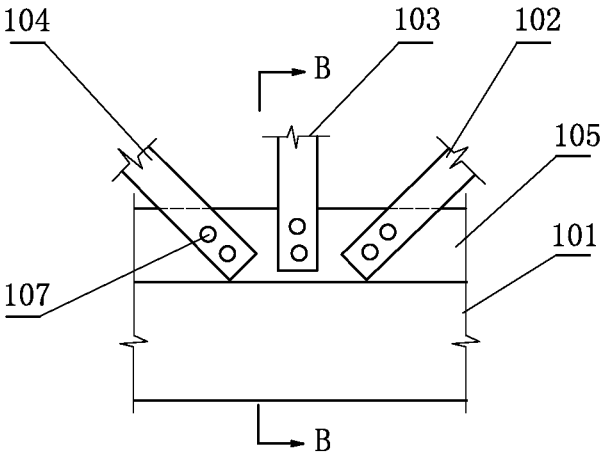
FIG. 2 is an enlarged view of connection node A in the first embodiment as shown in FIG. 1.
Figure 3:
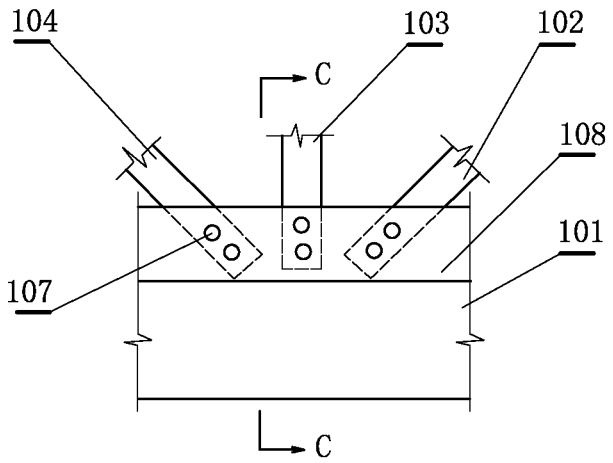
FIG. 3 is an enlarged view of connection node A in a second structure in the first embodiment.
Figure 4:
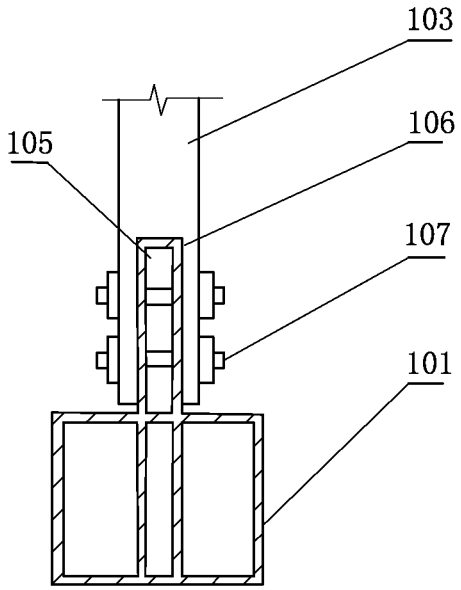
FIG. 4 is a cross-sectional view of FIG. 2 taken along B-B line in the first embodiment.
Figure 5:
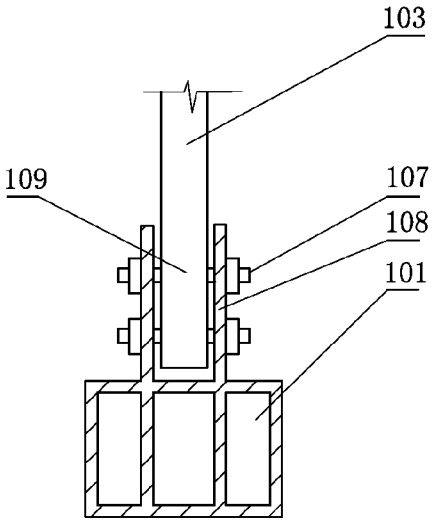
FIG. 5 is a cross-sectional view of FIG. 3 taken along C-C line in the first embodiment.

Referring to FIGS. 1-5, there is illustrated an aluminum alloy truss structure, comprising upper chord members, lower chord members, web members and all connection nodes by which the members are interconnected using riveting bolts; all members of the truss are made from aluminum alloy materials; the chord members and web members are interconnected using tenons and mortise grooves that mate with each other, each of the chord members being provided with a tenon plate at the end adjacent to the web members, each of the web members being correspondingly provided with a mortise groove at either end thereof to mate with the tenon plate, and the tenon plate on the chord members being implanted into the mortise groove on the web members; or, alternatively, each of the chord members being provided with a mortise groove at the end adjacent to the web members, each of the web members being correspondingly provided with a tenon at either end thereof to mate with the mortise groove, either end of each web member being implanted into the mortise groove on the chord member that intersects with the web member; after each tenon is implanted into the respective mortise groove, they are fastened together using bolts or riveting bolts. This embodiment deals with a planar truss structure, also referred to a simple truss structure, all the members of which are made from aluminum alloy materials. The connection node A is located on the lower chord member and the connection node A1 on the upper chord member. Referring to FIG. 1 and FIG. 2, the upper chord member 110 runs along the whole length of the truss and is configured to have a plurality of connection nodes with identical structures. Similarly, the lower chord member 110 runs along the whole length of the truss and is configured to have a plurality of connection nodes with identical structures as well. Both the upper chord member and lower chord member may be of rectangular-shaped tubular member. Alternatively, they may be configured to have a cross section in form of square with a single or a plurality of holes being made thereon, and ribs may be provided along the walls of the square-shaped members. The detail sizes, such as length, cross-sectional dimensions and wall thickness of the square-shaped upper chord member and lower chord member are determined according to the actual engineering conditions. A connection node (node A) on the lower chord member 101 is configured to fix the web members 102, 103 and 104. A connection node (node A1) on the upper chord member 101 is configured to fix the web members 102 and 103. Referring to FIG. 4, a tenon plate 105 is provided on the lower chord member and implanted into the mortise groove 106 on the web members 102, 103 and 104, and then fastened together with the mortise groove 106 using bolt 107 or riveting bolt. Such a connection node is referred to as riveting bolt type connection node (also called mating tenon-mortise groove connection node). The lower chord member mates with the web members via the tenons and mortise grooves respectively disposed on the lower chord member and the web members. Each of the web members has a groove made at either end thereof which acts as a mortise. Each of the web members may be in form of rectangular-shaped tubular member or square-shaped member with a singe or a plurality of holes being made therethrough. In case of small span trusses, the internal stress in the web members is less. Alternatively, the members may be solid. The detail sizes, such as length, cross-sectional dimensions of the web members are determined according to the actual engineering conditions. Referring to FIG. 3 and FIG. 5, there is illustrated a second structure of this embodiment. A mortise groove 108 is provided on the lower chord member to receive the tenon 109 on the web members 102, 103 and 104, and then fastened together with the tenon 109 using bolts or riveting bolts. The lower chord member mates with the web members via the mortise grooves and tenons respectively disposed on the lower chord member and the web members. Each of the web members is provided at either end thereof with a tenon 109. In this embodiment, the structure of the connection node A1 on the upper chord member is identical as that of the connection node A on the lower chord member. Although the number of the web members intersecting at individual connection nodes may vary slightly, the mating and connecting relationship between various tenons and mortise grooves are identical. The aluminum alloy truss structure in accordance with this embodiment may not only act as a crossbeam (as shown in FIG. 1), but a column (referred to as a truss column).

Described below is an example of the truss structure in accordance with this embodiment being used to construct a factory building truss purlin beam having a span of nine meters. According to the original design scheme, welded steel pipe trusses of Q235B materials are used. By consuming 122 kg of steel materials at a unit price of RMB 5000 per ton, each truss will cost RMB 610. Now, planar trusses involving the use of riveting bolt type connection nodes made from Series 6 aluminum alloy materials are employed instead. Seeing that the span is less, and, consequently, the cross section of the members is less, it is decided that solid chord members having type II cross section are provided with mortise grooves to receive the tenons provided on square-shaped web members respectively having a single hole made therethrough. Alternatively, solid chord members with a T-shaped cross section are provided with tenons to mate with the respective mortise grooves provided on either end of the square-shaped web members respectively having a single hole made therethrough. By consuming 41 kg of aluminium alloy materials at a unit price of RMB 22000 per ton, each aluminium alloy truss involving the use of riveting bolt type connection nodes will cost RMB 902.

Described below is a second example of the truss structure in accordance with this embodiment being used to construct a factory building truss column having a height of six meters. According to the original design scheme, welded steel pipe truss columns of Q235B materials are used. By consuming 128 kg of steel materials at a unit price of RMB 5000 per ton, each truss will cost RMB 640. Now, truss columns involving the use of riveting bolt type connection nodes made from Series 6 aluminum alloy materials are employed instead. By consuming 40 kg of aluminium alloy materials at a unit price of RMB 22000 per ton, each such truss column will cost RMB 880.

It follows from the practical examples of civil engineering works described above that, despite the fact that an aluminum alloy truss costs more than a steel truss, it has a weight of around 30% of that of the steel truss, considerably reducing the own weight of buildings. Also, this will contribute to a save of materials of columns and foundations on which the trusses rest, and, consequently, is advantageous in cutting the construction costs of civil projects and can further increase the earthquake resistant performance of structures. Moreover, aluminum alloy materials are far more corrosion resistant and durable than any other metals. The tests made by the relevant departments indicate that, aluminum alloy materials reduce in thickness at a rate of 0.5 microns per year, and will reduce in thickness by only 50 microns after being exposed to atmospheric corrosion for one hundred years, which is almost negligible. Aluminum alloy materials almost require no maintenance during their service life, making it possible for civil engineering works structures made from them to function for more than one hundred years.

Embodiment 2

Figure 6:
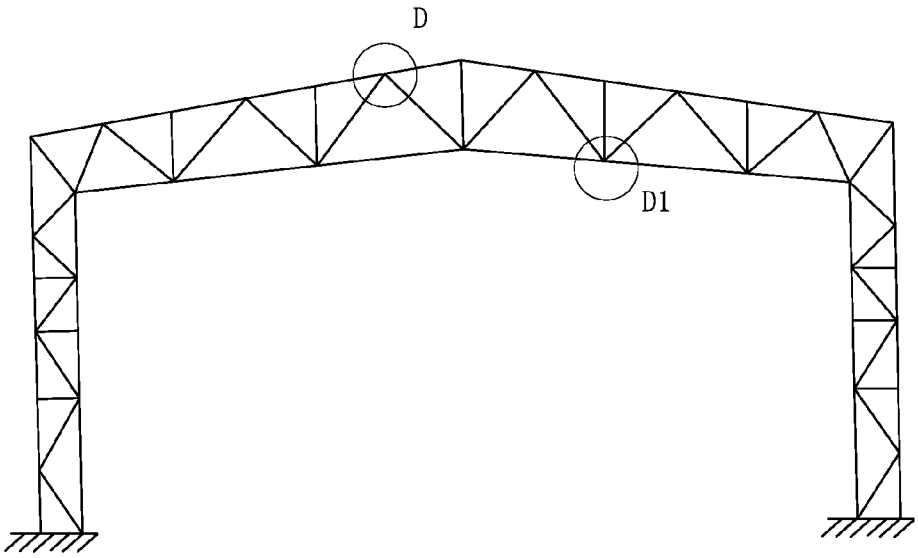
FIG. 6 is a schematic view of a second embodiment of the truss structure in accordance with this invention.
Figure 7:
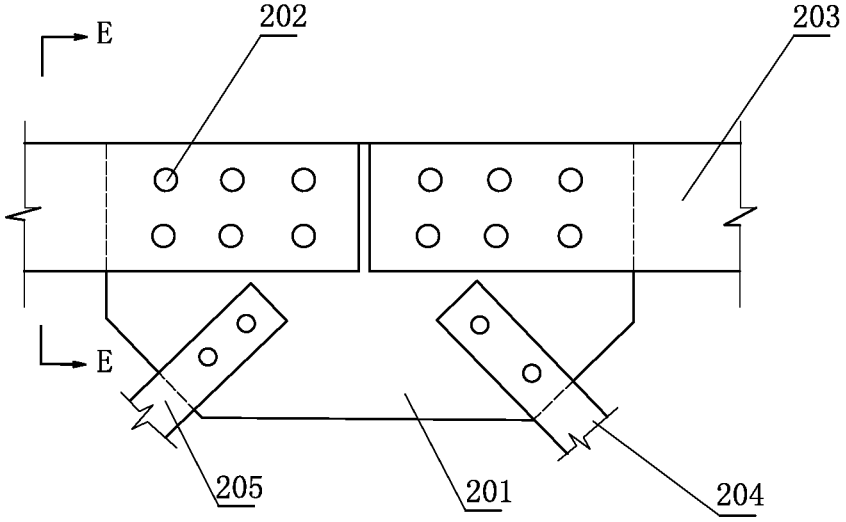
FIG. 7 is an enlarged view of connection node D of the truss structure in the second embodiment as shown in FIG. 6.
Figure 8:
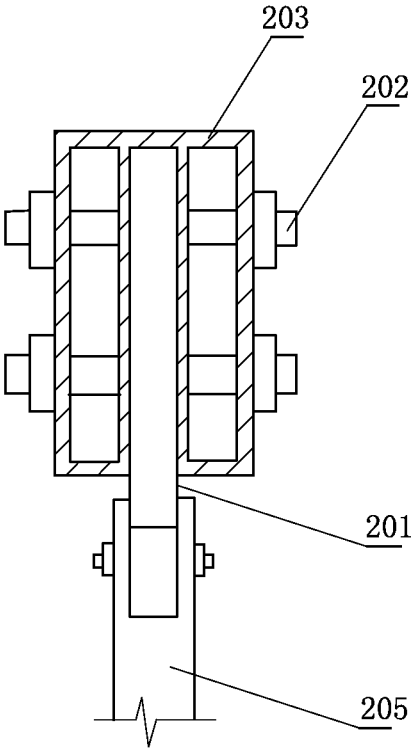
FIG. 8 is a cross-sectional view of FIG. 7 taken along E-E line in the second embodiment.

Referring to FIGS. 6-8, there is illustrated an truss structure, comprising a plate-shaped connection node plate and chord members and web members of aluminum alloy materials respectively connecting therewith, all the aluminum alloy members of the truss each having a groove made at either end thereof, the plate-shaped connection node plate being implanted into the grooves at the respective ends of all members that meet at a node and fastened together with the members using bolts or riveting bolts.

Referring to FIG. 6, this embodiment deals with a planar truss structure, comprising a plurality of connection notes D and D1 which are of the same structure. A implanted plate type structure is disposed respectively at the connection nodes. All the connection node plates and all truss members are fabricated using aluminum alloy materials. Each member is provided at either end (two ends in total) thereof with an opening (groove). Each connection node plate is implanted into the respective opening (groove) of all the members that intersect at the node and then fastened together with the members using bolts or riveting bolts. The truss members consists of a plurality of upper chord members, a plurality of lower chord members and a plurality of web members consisting of diagonal ones and vertical ones. The truss can have an either large or small span, and are widely employed in civil engineering works such as large-span factory buildings, exhibition halls, stadiums and bridges etc. Referring to FIG. 7 and FIG. 8, the upper chord member 203, web member 204 and web member 205 of the truss are each provided at either end thereof with an opening (groove) which is used to receive the connection node plate 201. The connection node plate and the members are fastened together by using bolt 202 of stainless steel or aluminum alloy. The upper chord member, lower chord member and web members may have a cross section in form of square with a singe or a plurality of holes being made therethrough. The cross-sectional dimensions, wall thickness, length of the square-shaped members are determined according to the actual engineering conditions. The dimensions, thickness of the connection node plate, the sizes of the grooves at the end of the members as well as the sizes and quantity of the fastening bolts are all determined when designing the connection nodes. The truss structure in accordance with this embodiment may also be referred to as aluminum alloy planar truss involving the use of implanted plate type plate-shaped connection nodes.

Described below is an example of the truss structure in accordance with this embodiment being used to construct an arch-shaped roof of a basketball gymnasium in a coastal city in south China. The arch-shaped roof truss structure has a span of 33 meters and a thickness of 1.65 meters, with the height of the arch camber being 4.95 meters. According to the original design scheme, welded steel pipe trusses of Q235B materials are used. By consuming 1920 kg of steel materials at a unit price of RMB 5000 per ton, each truss will cost RMB 9600. Now, the planar truss system involving the use of implanted plate type plate-shaped connection nodes that is made from Series 6 aluminum alloy materials is employed instead. By consuming 620 kg of aluminium alloy materials at a unit price of RMB 22000 per ton, each aluminium alloy truss will cost RMB 13640.

The aluminum alloy planar truss involving the use of implanted plate type plate-shaped connection nodes in accordance with this embodiment comprises chord members and web members each having an groove made at either end thereof. It involves the use of connection nodes that are structured in form of implanted plate type connection node, namely, each connection node plate is implanted into the grooves at the respective ends of all members that intersect at a node and fastened together with the members using bolts or riveting bolts. This results in an aluminum alloy planar truss system that is stressed reasonably, structured reliably and can be easily designed, fabricated and constructed. The connection nodes of aluminum alloy planar truss involving the use of implanted plate type plate-shaped connection nodes have overcome the deficiencies of aluminum alloy materials that they are difficult to weld and, therefore, place high technical requirements in this respect, the heat affected regions is unavoidable in welded aluminum alloy thus leading to reduced material strength, and the welding of aluminum alloy materials cannot be carried out at workshops conveniently and is difficult to perform at contraction site. As a result, the use of aluminum alloy structures will become popular.

Embodiment 3

The truss structure in accordance with this embodiment comprises all body-shaped connection node bodies of the space truss and all aluminum alloy members of the space truss that intersect at the respective connection nodes and are interconnected with the respective connection node bodies, all the aluminum alloy members of the space truss each having an groove made at either end thereof to receive an limb plate of a connection node body that is implanted into the groove, each body-shaped connection node body being provided with three limb plates, respectively referred to as U, V and W, along X, Y and Z direction of the space truss, the three limb plates being respectively implanted into the grooves at the ends of all members that respectively intersect along X, Y and Z direction at a node and fastened together with the members using bolts or riveting bolts.

Figure 11:
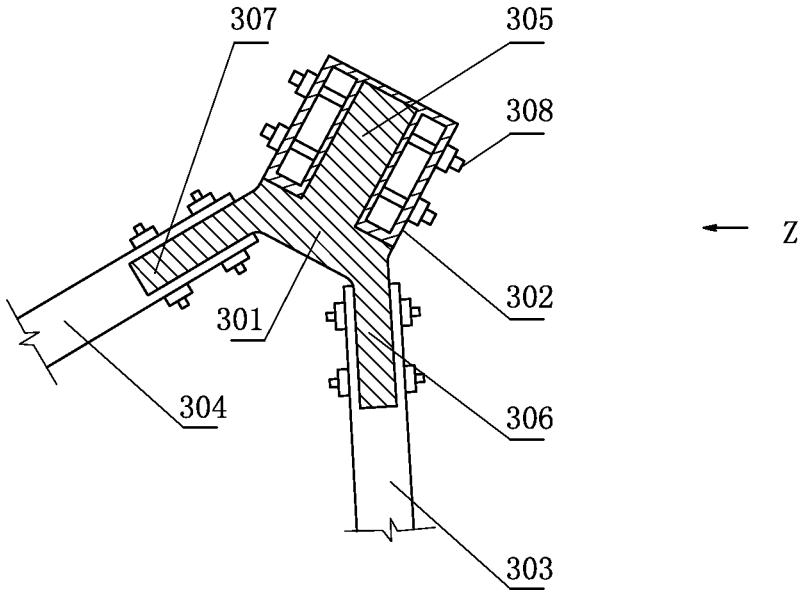
FIG. 11 is a cross-sectional view of FIG. 10 taken along X-X line in the third embodiment.
Figure 12:
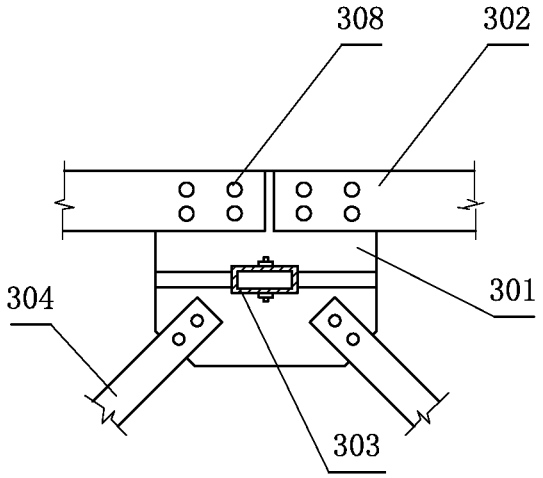
FIG. 12 is a cross-sectional view of FIG. 10 taken along Y-Y line in the third embodiment.
Figure 13:
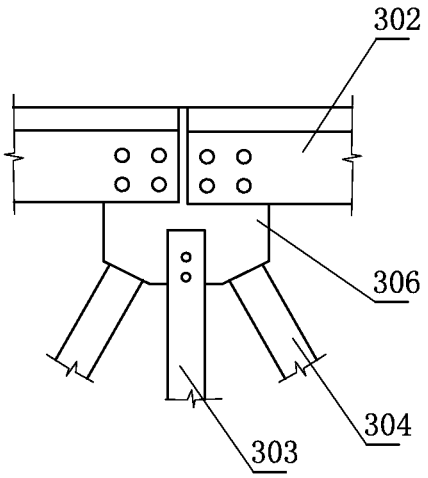
FIG. 13 is a view of FIG. 11 in the third embodiment when viewed from Z direction.
Figure 14:
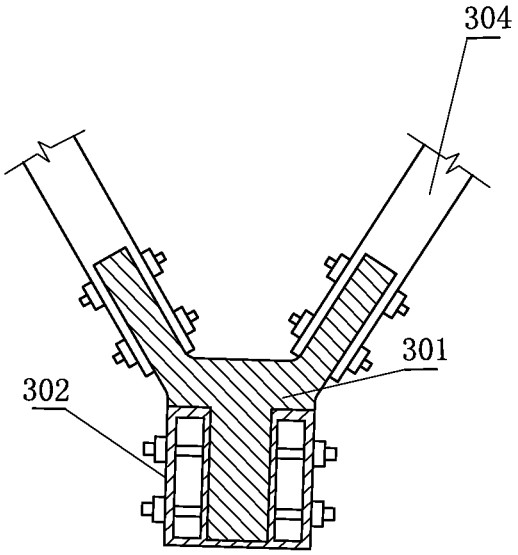
FIG. 14 is a cross-sectional view of FIG. 10 taken along X1-X1 line in the third embodiment.
Figure 15:
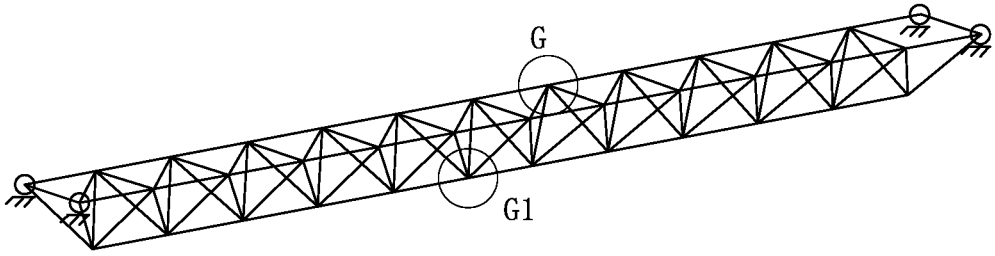
FIG. 15 is a schematic view of a fourth embodiment of the truss structure in accordance with this invention.

Referring to FIGS. 9-14, there is illustrated an aluminum alloy truss structure involving the use of implanted plate type body-shaped connection nodes according to the rule of "three non-coplanar link members can fix a new connection node in the space" and all the connection node bodies and members are made from aluminum alloy materials. The truss structure can have an either large or small span, and are widely employed in civil engineering works such as large-span factory buildings, exhibition halls, stadiums, bridges and tower-shaped structures. The truss in accordance with this embodiment has a cross section in form of a triangle, and, therefore, it may be referred to as a triangular truss. As shown in FIG. 11, each of the truss members has a groove made at either end thereof that receives a limb plate of the connection note body 301. Referring to FIG. 11, the connection node body in this embodiment is in form of an aluminum alloy section, comprising three limb plates, namely, chord limb plate 305, left limb plate 307 and right limb 306. The connection node body has a herringbone cross section. The chord limb plate 305 may also be called as limb plate U, the left limb plate 307 may be called as limb plate W and the right limb plate 306 may be called as limb plate V. When the connection node F of the truss in this embodiment is placed in a three-dimensional coordinate system (namely, a coordinate system consisting of X axis, Y axis and Z axis), the upper chord member and the chord limb plate is parallel to X axis, and the right limb plate and the straight web member is parallel to Y axis. The upper chord member 302 of the connection node F is fastened together with the chord limb plate, the straight web member (the horizontal web member) 303 is fastened together with the right limb plate, and the oblique web member 304 is fastened together with the left limb plate. After the limb plates of the connection node body are implanted into the groove of the respective members, they all fastened together with the members using a plurality of bolts 308 or riveting bolts. FIG. 12 illustrates the case where two upper chord members and two oblique web members are assembled together with the connection node body. FIG. 13 illustrates the case where two upper chord members, two oblique web members and one straight web member are assembled together with the connection node body. Referring to FIG. 14, the connection node body of the connection node F1 in this embodiment is identical to the connection node body of the connection node F, being simply rotated by an angle. In this case, the chord limb plate is disposed downwards and the left limb plate and the right limb plate are disposed upwards. FIG. 14 illustrates the case where two lower chord members and two oblique web members are assembled together with the connection node body.

Figure 22:
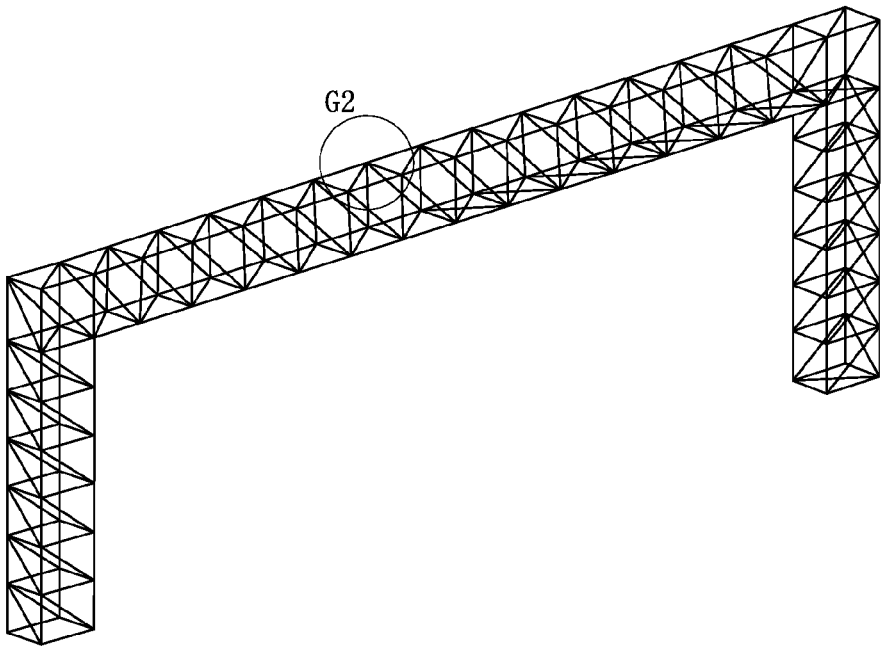
FIG. 22 is a schematic view of the fourth embodiment in a second structure in accordance with this invention.

The truss in accordance with this embodiment has a cross section in form of a triangle, and, therefore, it may be referred to as a triangular truss. The connection node body in this embodiment may be used in rectangular trusses, namely, which have a cross section in form of a rectangle. FIG. 22 illustrates the overall structure of the truss, and the connection node body used therein has a same structure as that described in this embodiment.

All the aluminum alloy members of the truss structure in this embodiment may be configured to have a cross section in form of square with a single or a plurality of holes being made thereon, and ribs may be provided along the walls of the square-shaped members. The length, cross-sectional dimensions and wall thickness of the square-shaped members are determined according to the actual engineering conditions. The opening and length of the groove at the respective member ends are determined according to the design. The centrelines of the cross sections of the three limb plates of the connection node body meet at a point. The included angles between the three limb plates, the thickness of the limb plates and the length of the connection node body are determined when designing the connection node. The diameter and number of the fastening bolts or riveting bolts are determined through calculation.

Figure 9:
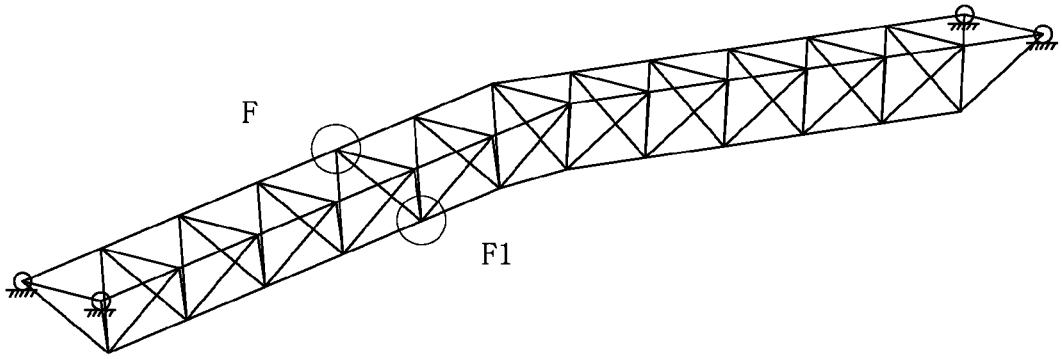
FIG. 9 is a schematic view of a third embodiment of the truss structure in accordance with this invention.
Figure 10:
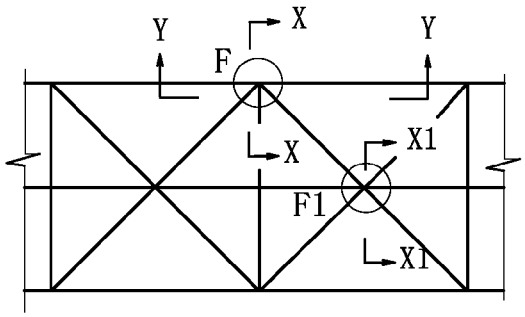
FIG. 10 is a top view of connection node F in the third embodiment as shown in FIG. 9.

Another type of truss in accordance with this embodiment is triangular truss (the overall structure thereof is shown in FIG. 9). The left portion of the said truss comprises a plurality of upper chord members that are connected end to end and a connection node body is disposed at locations where every two upper chord members join. The right portion of the said truss comprises a plurality of upper chord members that are connected end to end (the structure of the joining structure of the upper chord members are shown in FIG. 12) and a connection node body is disposed at locations where every two upper chord members join. The bottom portion of the said truss comprises a plurality of lower chord members that are connected end to end and a connection node body is disposed at locations where every two lower chord members join. The said connection node body comprises a chord limb plate, a left limb plate and a right limb plate and have a herringbone cross section. The left limb plate and the right limb plate are disposed symmetrically (the structure of the connection node body is shown in FIG. 11 and FIG. 14). At the left portion of the truss, the chord limb plate of each connection node body is connected with the upper chord member and the left limb plate of the connection node body is connected with the oblique web member (the connection of the oblique web member is shown in FIG. 13). At the right portion of the truss, the chord limb plate of each connection node body is connected with the upper chord member and the right limb plate of the connection node body is connected with the oblique web member. At the bottom portion of the truss, the chord limb plate of each connection node body is connected with the lower chord member. The right limb plate of the connection node body at the left portion of the truss is connected with the left limb plate of the connection node body at the right portion of the truss via a straight web member. The left limb plate of the connection node body at the bottom portion of the truss is connected with the oblique web member of the connection node body at the left portion of the truss and the right limb plate of the connection node body at the bottom portion of the truss is connected with the oblique web member of the connection node body at the right portion of the truss. In this embodiment, the connection between the right limb plate of the connection node body at the left portion of the truss and the left limb plate of the connection node body at the right portion of the truss via a straight web member refers to the connection between any two connection node bodies that are next to each other. The connection between the left limb plate of the connection node body at the bottom portion of the truss and the oblique web member of the connection node body at the left portion of the truss refers to the connection between any two connection node bodies that are next to each other. The connection between the right limb plate of the connection node body at the bottom portion of the truss and the oblique web member of the connection node body at the right portion of the truss refers to the connection between any two connection node bodies that are next to each other. In this embodiment, at the left portion of the truss, two adjacent connection node bodies share one upper chord member; at the right portion of the truss, two adjacent connection node bodies share one upper chord member; at the bottom portion of the truss, two adjacent connection node bodies share one lower chord member; at either end of the truss, the connection node body is connected with only one upper chord member or lower chord member.

Embodiment 4

Referring to FIGS. 15-26, there is illustrated an aluminum alloy truss structure, comprising chord members, web members and all connection nodes by which the members are interconnected using riveting bolts; all members of the truss are made from aluminum alloy materials; the chord members and web members are interconnected using tenons and mortise grooves that respectively mate with each other; in particular, a tenon plate is provided at the chord member respectively along Y, Z direction of the space truss, and a mortise groove is made at either end of each of the web chamber along Y, Z direction of the space truss to mate with the tenon plate, the tenon plates at the chord member along Y, Z direction being implanted into the mortise grooves in the web members along Y, Z direction respectively that intersect the chord member; or, alternatively, a mortise groove is made at the chord member respectively along Y, Z direction of the space truss, and a tenon is respectively provided at either end of each of the web chamber along Y, Z direction of the space truss to mate with the mortise groove, the tenon at either end of each web member along Y, Z direction being implanted into the mortise groove in the chord member along Y, Z direction respectively that intersects the chord member; after each tenon is implanted into the respective mortise groove, they are fastened together using bolts or riveting bolts.

The embodiment is according to the rule of "three non-coplanar link members can fix a new connection node in the space". All the members are made from aluminum alloy materials. A chord member and a web member are interconnected with a tenon and a mortise groove which mate with each other and are then fastened together using bolts or riveting bolts. The truss structure can have an either large or small span, and are widely employed in civil engineering works such as large-span factory buildings, exhibition halls, stadiums, bridges and tower-shaped structures. The truss in accordance with this embodiment has a cross section in form of a triangle, and, therefore, it may be referred to as a triangular truss or a triangular space truss. In this embodiment, there are two upper chord members disposed symmetrically with respect to each other and one lower chord member. Both the upper chord member and the lower chord member are of a triangular pipe piece over their whole length and each of the triangular pipe pieces has a triangular cross section with a single opening made therethrough.

Figure 16:
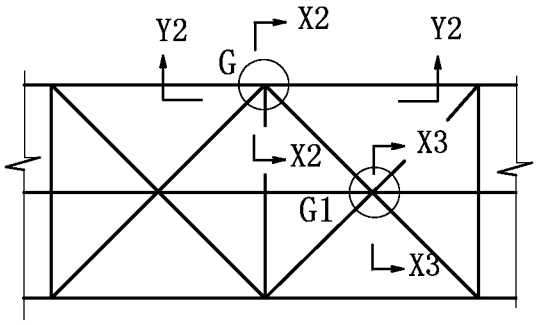
FIG. 16 is a top view of connection node G in the fourth embodiment as shown in FIG. 15.
Figure 17:
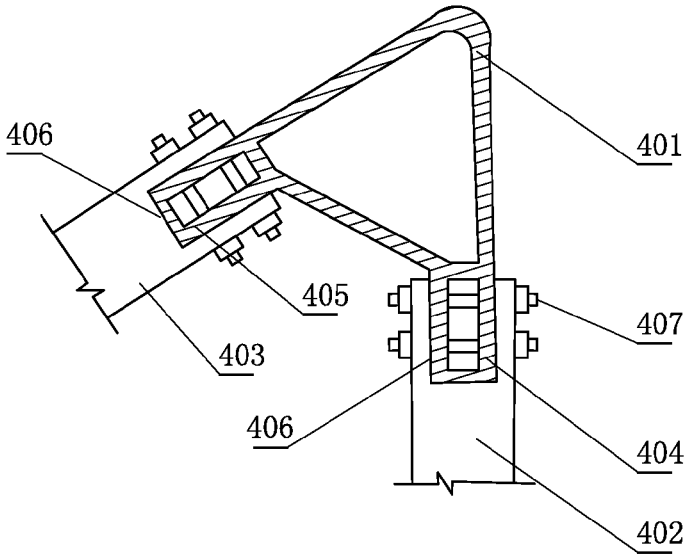
FIG. 17 is a cross-sectional view of FIG. 16 taken along X2-X2 line in the fourth embodiment.
Figure 18:
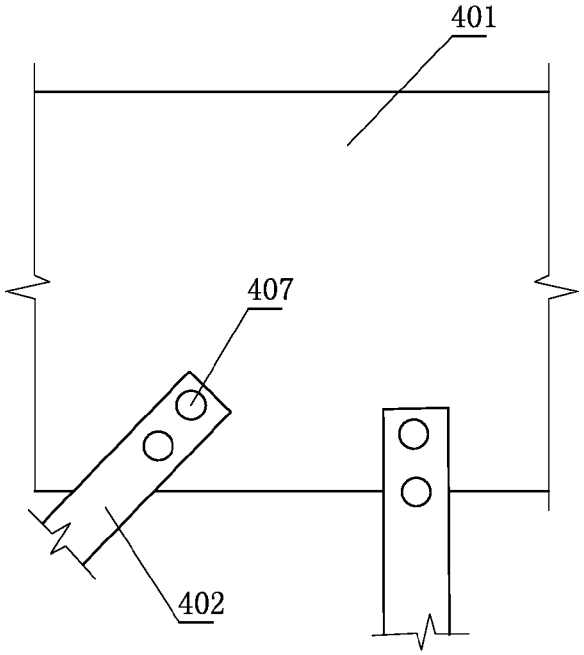
FIG. 18 is an enlarged partial view of connection node G in the fourth embodiment as shown in FIG. 16.
Figure 19:
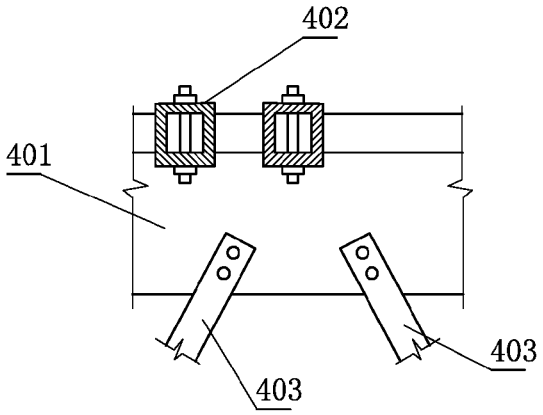
FIG. 19 is a cross-sectional view of FIG. 16 taken along Y2-Y2 line in the fourth embodiment.
Figure 21:
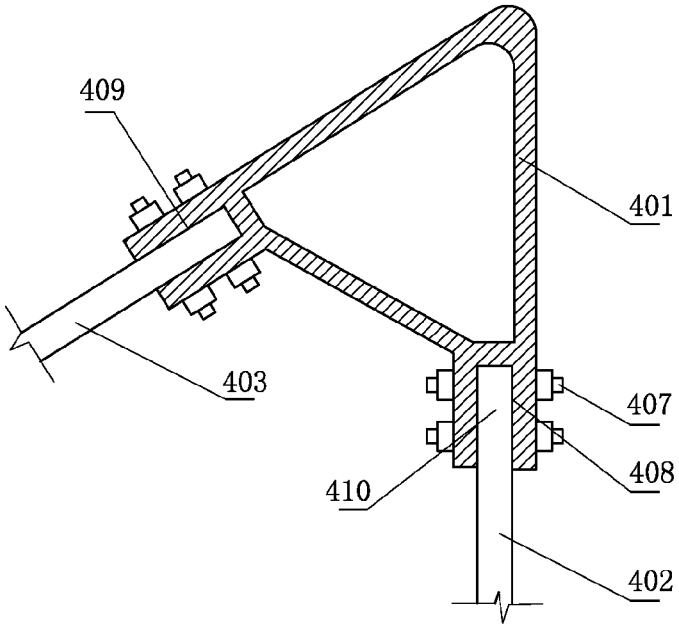
FIG. 21 is a cross-sectional view of connection node A in a second structure in the first embodiment

Referring to FIGS. 16-19, in the structure of connection node G of this embodiment, the upper chord member 401 is interconnected respectively with the straight web member (i.e., the horizontal web member) 402 and the oblique web member 403 via a tenon and a mortise groove that mates with each other. FIG. 17 illustrates a structure in which the upper chord member 401 has the tenon 404 implanted into the mortise groove 406 of the straight web member 402 and has another tenon 405 implanted into the mortise groove 406 of the oblique web member 403. FIG. 21 illustrates a second type of connection node structure. In this connection node structure, the tenon 410 of the straight web member 402 is implanted into the mortise groove 408 of the upper chord member 401 and the tenon of the oblique web member 403 is implanted into the mortise groove 409 of the upper chord member. In practice, the option of mating between a tenon and a mortise groove is determined according to the actual project conditions. A tenon plate may be either a solid plate or a hollow plate. The two walls of a mortise groove may be either a solid plate or a hollow plate. The relevant sizes of a tenon and a mortise groove are determined according to the actual project conditions. A member involving the use of a tenon and a member involving the use of a mortise groove is fastened together using bolts or riveting bolts 407 made from stainless steel. The diameter and quantity of bolts or riveting bolts are determined according to the actual project conditions.

When the connection node G of the truss in this embodiment is placed in a three-dimensional coordinate system (namely, a coordinate system consisting of X axis, Y axis and Z axis), the upper chord member is parallel to X axis and has a tenon plate provided respectively along Y axis and Z axis which are respectively implanted into the mortise groove of the respective web member.

Figure 20:
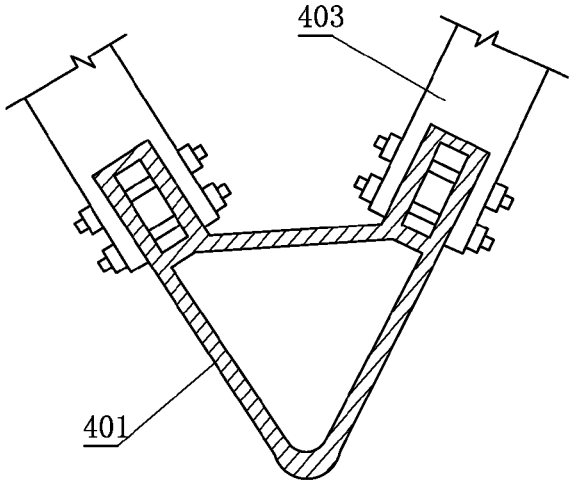
FIG. 20 is a cross-sectional view of FIG. 16 taken along X3-X3 line in the fourth embodiment.

Now go to FIG. 16 and FIG. 20. FIG. 20 illustrates a structure of connection node G1 of the truss of this embodiment. In this structure, the lower chord member of the truss has the same structure as that of the upper chord member and will not be described in detail herein.

Referring to FIGS. 22-26, a second type of truss structure in accordance with this embodiment has a cross section in form of a rectangle, and, therefore, it may be referred to as a rectangular truss or a rectangular space truss. In this embodiment, there are two upper chord members disposed symmetrically with respect to each other and two lower chord members disposed symmetrically with respect to each other as well. Both the upper chord member and the lower chord member are of a rectangular pipe piece over their whole length and each of the rectangular pipe pieces has a rectangular cross section with more than one openings made therethrough.

Figure 23:
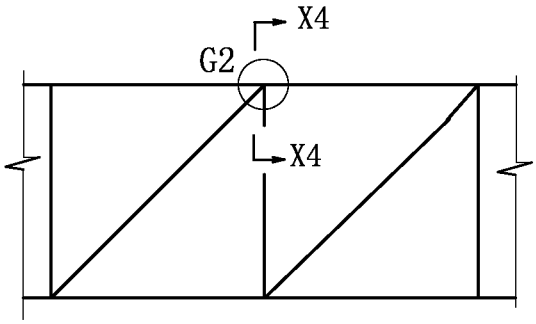
FIG. 23 is a top view of connection node G2 in the fourth embodiment as shown in FIG. 22.
Figure 24:
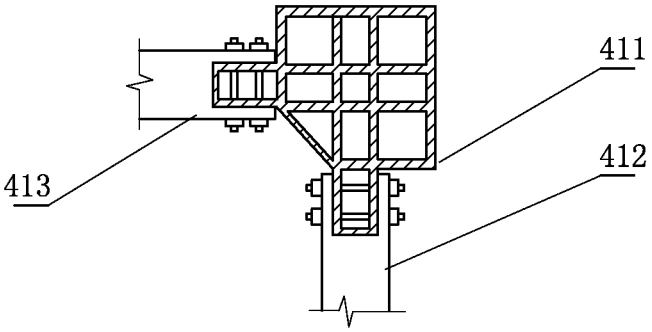
FIG. 24 is a cross-sectional view of FIG. 23 taken along X4-X4 line in the fourth embodiment.
Figure 25:
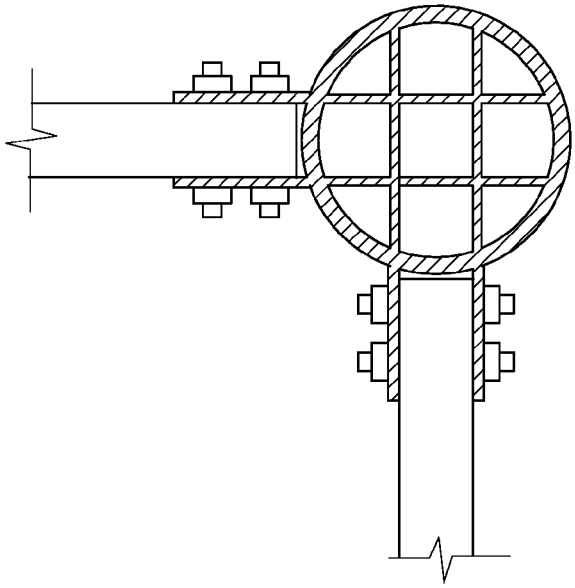
FIG. 25 is a cross-sectional view of the connection node in the second structure as shown in FIG. 23 in the fourth embodiment.
Figure 26:
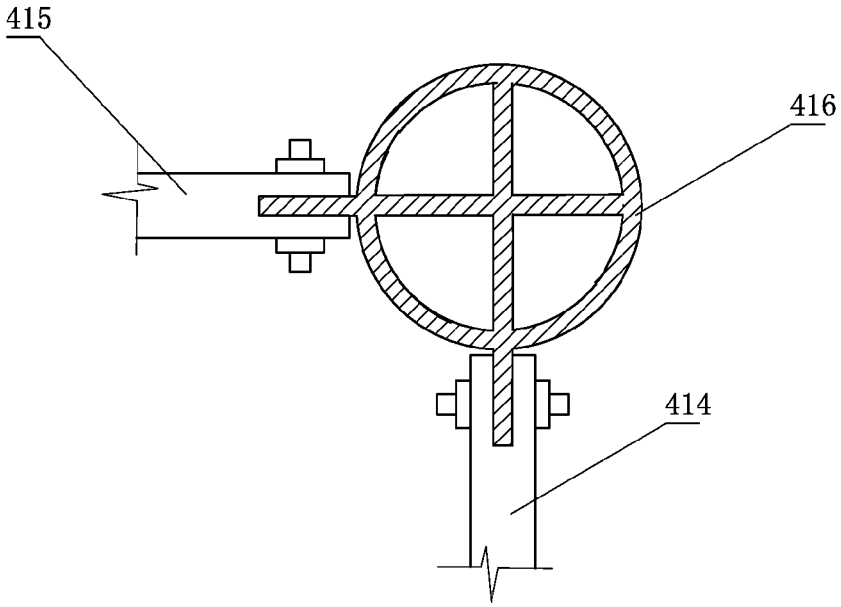
FIG. 26 is a cross-sectional view of the connection node in a third structure as shown in FIG. 23 in the fourth embodiment.

Referring to FIG. 23 and FIG. 24, there is illustrated a structure of connection node G2 of the truss of this embodiment. In this structure, the upper chord member 411 is interconnected respectively with the straight web member (i.e., the horizontal web member) 412 and the vertical web member 413 via a tenon and a mortise groove that mates with each other. FIG. 25 illustrates a second type of connection node structure in which both the upper chord member and the lower chord member are circular pipe pieces over their whole length and each of the circular pipe pieces has more than one openings made through its cross section. FIG. 26 illustrates a third type of connection node structure in which the upper chord member 416 has the tenon implanted into the mortise groove of the straight web member 414 and has another tenon implanted into the mortise groove of the oblique web member 415.

Described below is an example of the truss structure in accordance with this embodiment being used to construct a power transmission tower. The power transmission tower is 16.6 meters high and has a cross section in form of a rectangular space truss structure with variable sections. The maximum wind speed is 35 m/s; the icing thickness is 0 mm; the adjustment factor of wind pressure applied on the tower body is taken as 1.000; the adjustment factor of wind pressure used for design calculation of the foundation is taken as 1.0; the conductor is of 1×LGJ-150/25 type; the earth wire is of GJ-35 type; and external loads applied at the attachment points are calculated with the parameters provided by the electrical discipline using the computing programs designed for calculation of the external loads of towers. According to the original design scheme, welded space truss structures of Q235B angles are used. By consuming 1257 kg of steel materials at a unit price of RMB 5000 per ton, each tower will cost RMB 6285. Now, space truss structures involving the use of riveting bolt type connection nodes made from Series 6 aluminum alloy materials are employed instead. By consuming 400 kg of aluminium alloy materials at a unit price of RMB 22000 per ton, each aluminium alloy tower will cost RMB 8800.

Embodiment 5

The truss structure in accordance with this embodiment comprises all body-shaped connection node bodies made from aluminum alloy materials and all chord members and web members of aluminum alloy materials that meet at respective connection nodes and are interconnected with the respective connection node bodies. In response to the needs for connecting the members, each body-shaped connection node body is provided with a limb plate of the connection node body respectively in positive and negative direction of X axis in XY plane to connect the truss chord members in X axis direction, or is provided with grooves to connect the truss chord members in X axis direction; and it is provided with a limb plate of the connection node body respectively in positive and negative direction of Y axis in XY plane to connect the truss chord members in Y axis direction, or is provided with grooves to connect the truss chord members in Y axis direction; and is provided with a limb plate or a groove at one side of the YZ plane to connect the truss web members, and is provided with a limb plate or a groove at the other side of the YZ plane symmetrically with respect to the said side; the truss members meeting at the connection node each has a groove made at either end thereof to receive the limb plate of the connection node body and then fastened together with the limb plate using bolts or riveting bolts; after the ends of truss members are respectively implanted into the grooves in the connection node body, they are fastened together using bolts or riveting bolts.

Figure 27:
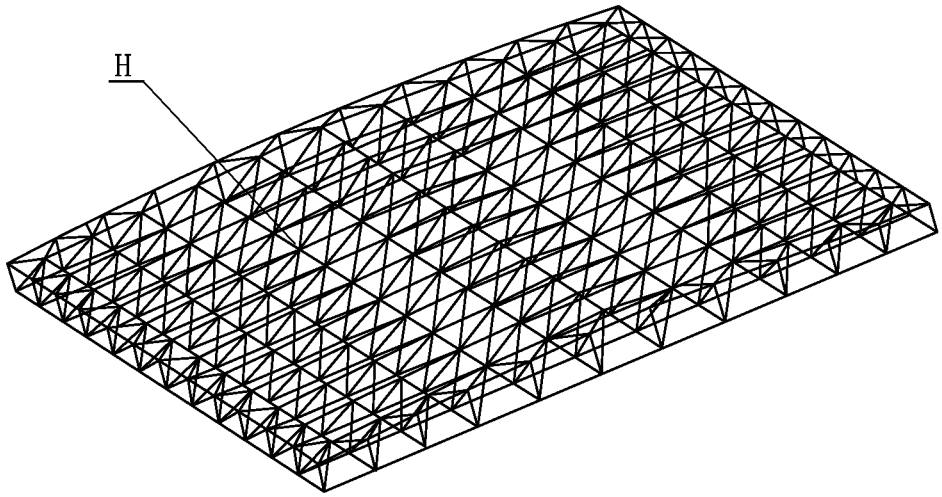
FIG. 27 is a schematic view of a fifth embodiment in accordance with this invention.
Figure 28:
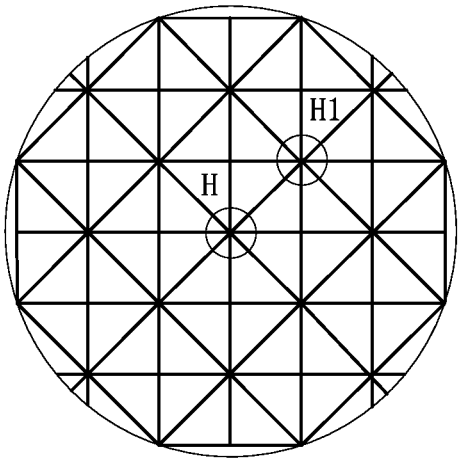
FIG. 28 is top view of connection node H in the fifth embodiment as shown in FIG. 27.

In the prior art, grid structures are generally classified into plane trussed lattice grids, square pyramid space grids and triangular pyramid space grids in terms of grid units combination mode. FIG. 27 illustrates an example of orthogonal and ortho-laid square pyramid space grid structure made from aluminum alloy materials involving the use of body-shaped connection nodes and FIG. 28 is an enlarged partial view of H connection node in the grid structure. All the chord members, web members and connection node bodies of the truss are made from aluminum alloy materials. The connection nodes of the truss structure may be either implanted plate type body-shaped connection nodes, or implanted rod type body-shaped connection nodes or body-shaped connection nodes involving the use of a combination of implanted plate and implanted rod, or a combination of the foregoing three types of body-shaped connection nodes. All the truss members are connected with respective connection node bodies using bolts or riveting bolts made from stainless steel or aluminum alloy materials. The members, connection node bodies and bolts are designed according to the relevant specifications to ensure that the structure is safe and reliable, and stressed reasonably, and consumes the minimum material as far as possible.

When the connection node H of the truss in accordance with this embodiment is placed in a three-dimensional coordinate system (namely, a coordinate system consisting of X axis, Y axis and Z axis), as shown in FIG. 28, the X axis is oriented from left to right, the Y axis is oriented from top to bottom and the Z axis is normal to the paper surface, and the origin of the coordinates is located at connection node H. The orientations of chord members, web members and limb plates of the connection note bodies in this embodiment can be understood with the aid of such three-dimensional coordinate system.

Figure 29:
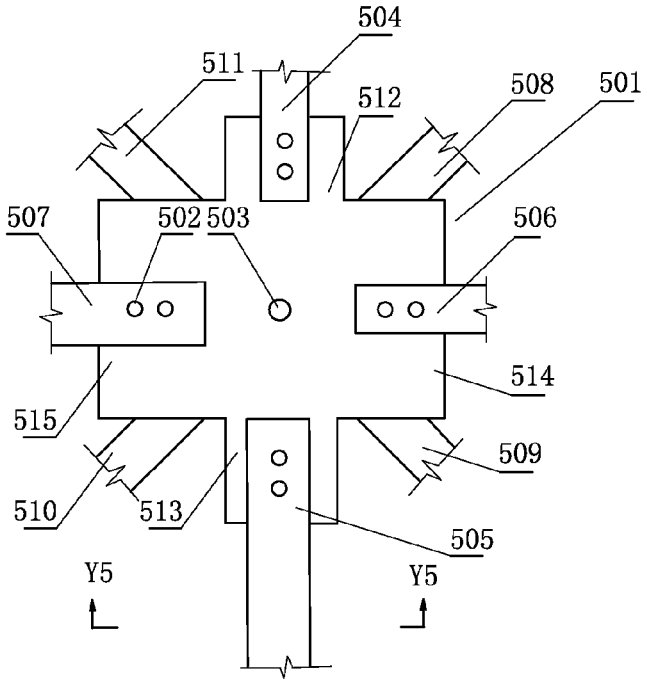
FIG. 29 is an enlarged view of connection node H in the fifth embodiment as shown in FIG. 28.
Figure 30:
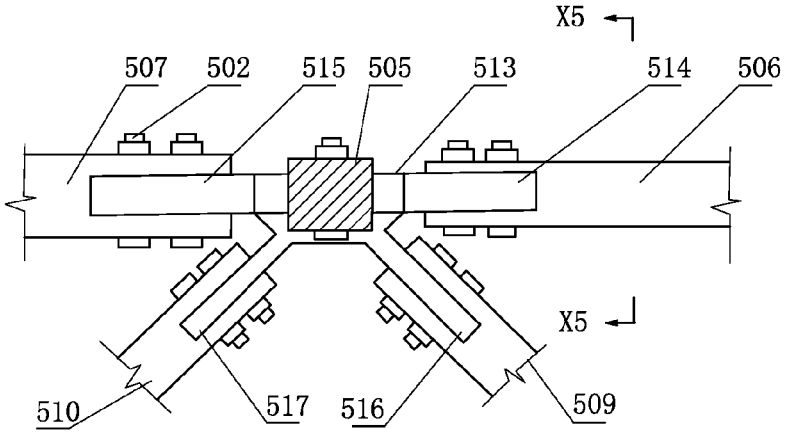
FIG. 30 is a cross-sectional view of FIG. 29 taken along Y5-Y5 line in the fifth embodiment.
Figure 31:
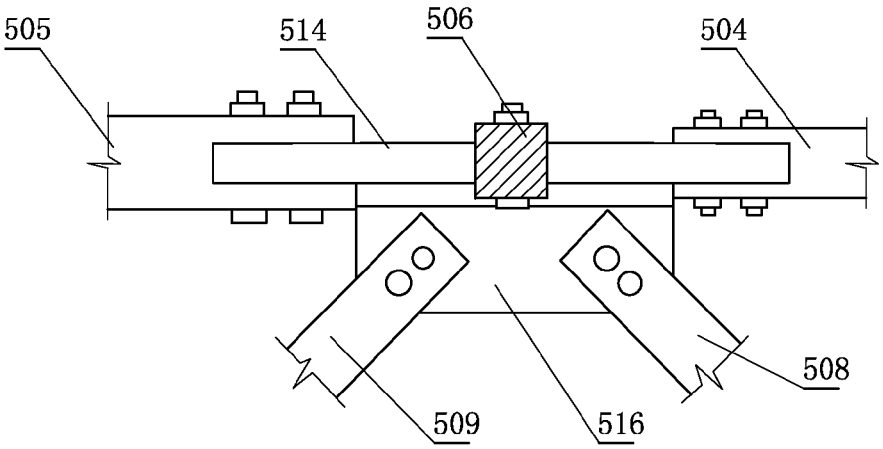
FIG. 31 is a cross-sectional view of FIG. 30 taken along X5-X5 line in the fifth embodiment.

Referring to FIGS. 27-31, the truss structure in accordance with this embodiment is in the form of a square pyramid space grid. The first mode for carrying out this embodiment is related to a implanted plate type body-shaped connection node structure. FIG. 29 illustrates a connection node body 501 of the connection node H where the upper chord member 504, the upper chord member 505, the upper chord member 506, the upper chord member 507, the oblique web member 508, the oblique web member 509, the oblique web member 510 and the oblique web member 511 meet. The upper limb plate 512, the upper limb plate 513, the upper limb plate 514 and the upper limb plate 515 are disposed in the directions respectively corresponding to the four upper chord members and the oblique limb plate 516 and the oblique limb plate 517 of the connection node body are disposed in the directions respectively corresponding to the four oblique web members. Referring to FIG. 30 and FIG. 31, the four upper chord members and the four oblique web members each has a groove made at either end thereof to receive the corresponding upper limb plates and oblique limb plates of the connection node body and are then fastened with the said limb plates using bolts or riveting bolts 502, thereby comprising an implanted plate type body-shaped connection node structure. A reserve bolt hole 503 is provided at the center of the connection node body. In the truss structure in accordance with this embodiment, there are a plurality of connection nodes, consisting of upper connection nodes and lower connection nodes. The connection node body respectively of an upper connection node and a lower connection node have the same structure and the installation directions thereof are spaced by 180 degrees. The connection node bodies are connected to the chord members and the oblique web members in the same way. The chord members that are connected with the connection node bodies of the upper connection nodes are called as upper chord members and the chord members that are connected with the connection node bodies of the lower connection nodes are called as lower chord members. As shown in FIG. 28, the connection node body of the connection node H is an upper connection node and the connection node body of the connection node H1 is a lower connection node, and the installation directions of the both are spaced by 180 degrees. The connection node body in this embodiment may also be understood as a connection node body in a square pyramid grid structure comprising a planar base plate. A front limb plate and a back limb plate are disposed along the extended longitudinal axis of the planar base plate and a left limb plate and a right limb plate are disposed along the extended transverse axis of the planar base plate. Two oblique limb plates are disposed at underside of the planar base plate. The two oblique limb plates are disposed in a splayed manner symmetrically with respect to the longitudinal axis and are parallel to each other. Each of the said two oblique limb plates make an angle of 25-75 degrees with the planar base plate.

Figure 32:
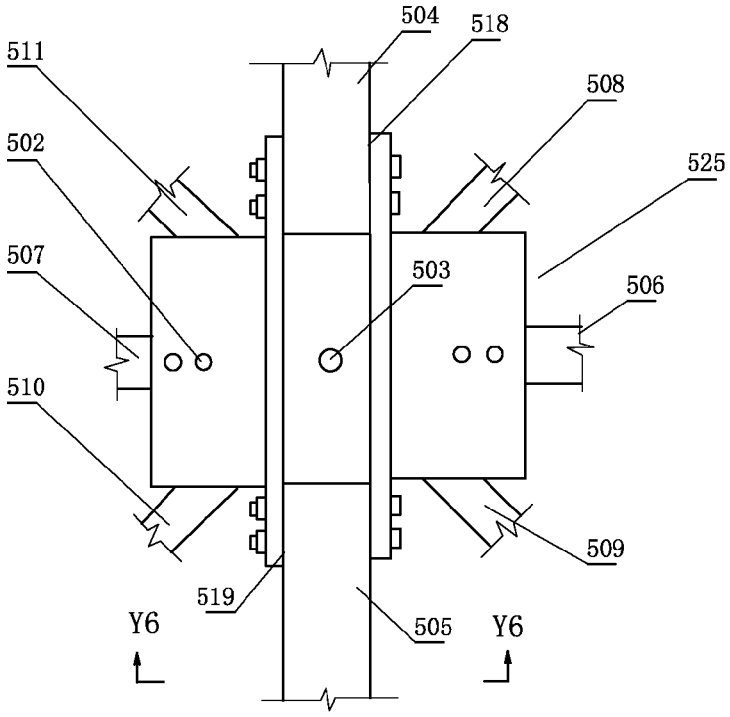
FIG. 32 is an enlarged view of connection node H in the second structure in the fifth embodiment.
Figure 33:
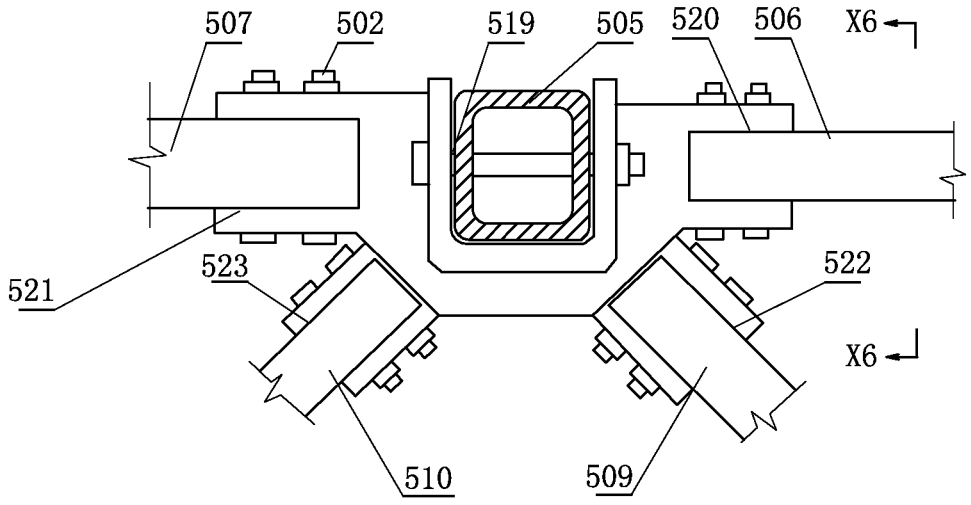
FIG. 33 is a cross-sectional view of FIG. 32 taken along Y6-Y6 line in the fifth embodiment.
Figure 34:
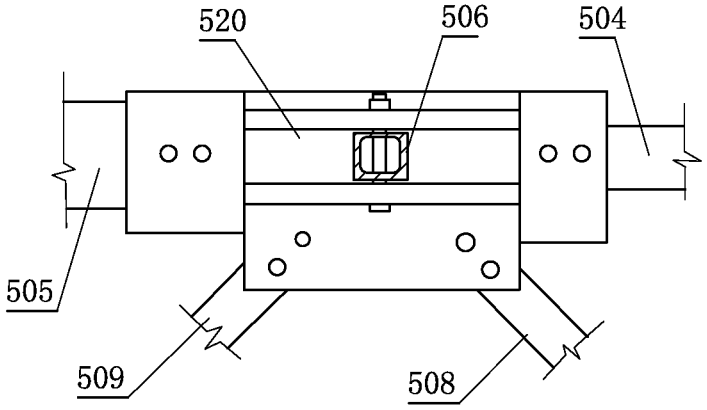
FIG. 34 is a cross-sectional view of FIG. 33 taken along X6-X6 line in the fifth embodiment.

Referring to FIG. 28 and FIGS. 32-34, the truss structure in accordance with this embodiment is in the form of a square pyramid grid. The second mode for carrying out this embodiment is related to a implanted rod type body-shaped connection node structure. FIG. 32 illustrates a connection node body 525 of the connection node H where the upper chord member 504, the upper chord member 505, the upper chord member 506, the upper chord member 507, the oblique web member 508, the oblique web member 509, the oblique web member 510 and the oblique web member 511 meet. The horizontal groove of connection node body 518, the horizontal groove of connection node body 519, the horizontal groove of connection node body 520 and the horizontal groove of connection node body 521 are provided in the directions respectively corresponding to the four upper chord members and the oblique groove of connection node body 522 and the oblique groove of connection node body 523 are provided in the directions respectively corresponding to the four oblique web members. Referring to FIG. 33 and FIG. 34, the ends of the four upper chord members and the four oblique web members are respectively implanted into the corresponding horizontal grooves and oblique grooves of the connection node bodies and are then fastened together with the connection node bodies using bolts or riveting bolts 502, thereby comprising an implanted rod type body-shaped connection node structure.

In case of a multi-layer grid structure, by providing on the connection node body two additional limb plates and two additional grooves at the grid structure side, the desirable connect node body can result. The form and sizes of the cross section of the members of the grid structure, the thickness of the connection node body and the sizes of the limb plates and grooves of the connection node body, the diameter and quantity of bolts and riveting bolts of stainless steel materials are all determined according to the relevant specifications during the design.

In the truss of this embodiment, the upper chord member 504 may also be understood as the chord member in the positive direction of X axis in XY plane of the grid structure; the upper chord member 505 may also be understood as the chord member in the negative direction of X axis in XY plane of the grid structure; the upper chord member 506 may also be understood as the chord member in the positive direction of Y axis in XY plane of the grid structure; the upper chord member 507 may also be understood as the chord member in the negative direction of Y axis in XY plane of the grid structure; the oblique web member 508 may also be understood as the web member in the XYZ direction of the grid structure; the oblique web member 509 may also be understood as the web member in the (−X)YZ direction of the grid structure; the oblique web member 510 may also be understood as the web member in the (−X)(−Y)Z direction of the grid structure; the oblique web member 511 may also be understood as the web member in the X(−Y)Z direction of the grid structure. The upper limb plate 512 may also be understood as the connection node body limb plate in the positive direction of X axis in XY plane of the grid structure; the upper limb plate 513 may also be understood as the connection node body limb plate in the negative direction of X axis in XY plane of the grid structure; the upper limb plate 514 may also be understood as the connection node body limb plate in the positive direction of Y axis in XY plane of the grid structure; the upper limb plate 515 may also be understood as the connection node body limb plate in the negative direction of Y axis in XY plane of the grid structure; the oblique limb plate 516 may also be understood as the connection node body limb plate at YZ plane side of the grid structure; the oblique limb plate 517 may also be understood as the connection node body limb plate at (−Y)Z plane side of the grid structure; and the similar situations can by determined by analogy.

In cases where a square pyramid grid structure drains water using two slopes, the left and right limb plate of the connection node body located at the roof ridge are inclined downwards towards the drainage slopes.

The connection node body of the aluminum alloy grid structure disclosed in this invention, either implanted plate type or implanted rod type, or the type involving the use of a combination of implanted plate and implanted rod, can ensure that the members meeting at a connection node in X, Y and Z direction (both positive and negative) can be installed in proper places flexibly and sufficient spaces are available for the use of bolts or riveting bolts to fasten them, thereby avoiding the adverse effects from any included angles and the sizes of the cross section of the members meeting at the connection node. In this way, the axis of centroids of cross sections of the individual members meeting at the connection node can intersect at a point thereby resulting in the formation of a concurrent force system. Moreover, the connection between the individual members and the connection node body can be fastened independently without interference between each other. The connection node body of the aluminum alloy grid structure in this invention is configured in such a manner that the force transmission path of the members, bolts and connection node body is definite, and the nature of the working internal forces of the individual stressed members of the grid structure (tension, compression or shear) is readily apparent, making it possible for a regular mechanical mode to be presented for structural analysis. As long as the professionals design the members, connection node body and bolts by following the relevant civil engineering codes, the individual stressed members of the grid structure can meet the requirements in terms of structure, strength and rigidity, the connection node and the members can function cooperatively and the entire structure system can function reliably and safely.

Embodiment 6

Figure 35:
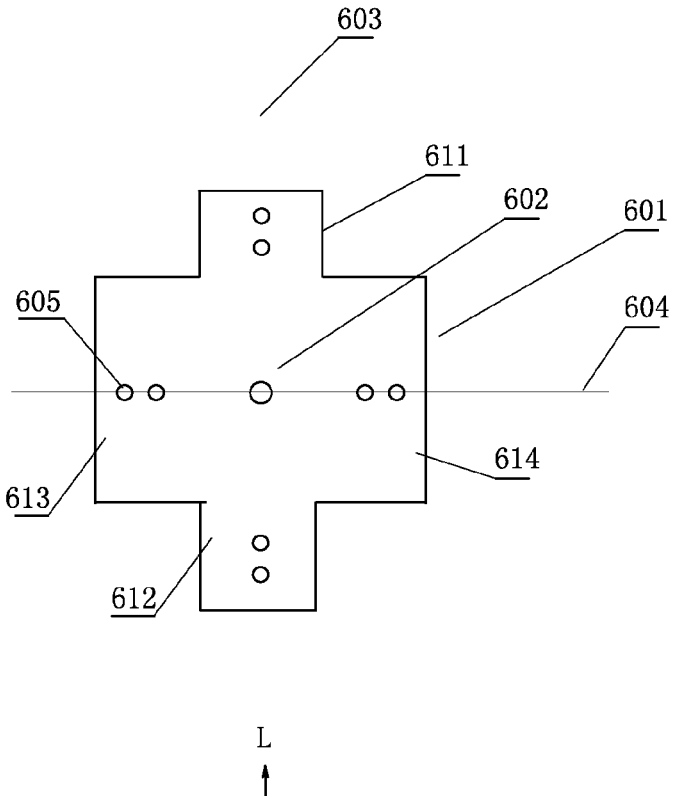
FIG. 35 is a top view of a connection node body in a sixth embodiment.
Figure 36:
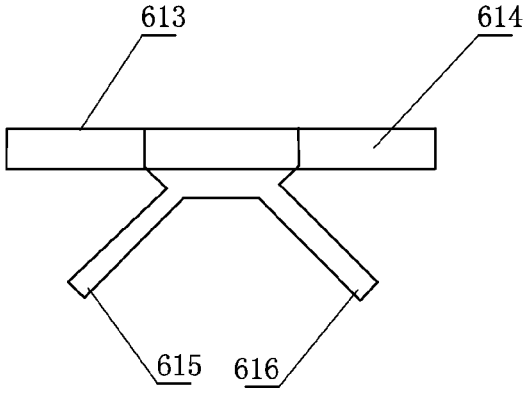
FIG. 36 is a view of FIG. 35 of the sixth embodiment when viewed from L direction.
Figure 37:
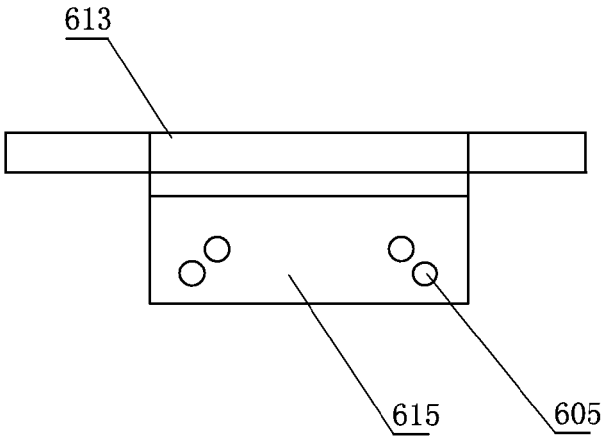
FIG. 37 is a left view of FIG. 36 in the sixth embodiment.

Referring to FIGS. 35-37, the connection node body 601 involved in the square pyramid grid structure in this embodiment comprises a planar base plate 602. A front limb plate 611 and a back limb plate 612 are disposed along the extended longitudinal axis 603 of the planar base plate and a left limb plate 613 and a right limb plate 614 are disposed along the extended transverse axis 604 of the planar base plate. Two oblique limb plates 615, 616 are disposed at underside of the planar base plate. The two oblique limb plates are disposed in a splayed manner symmetrically with respect to the longitudinal axis and are parallel to each other. The six limb plates each has a bolt hole 605 provided therethrough. Each of the said two oblique limb plates make an angle of 25-75 degrees with the planar base plate. The prior-art square pyramid grid structure is known to those skilled in the art and will not be described in detail herein.

The application of the connection node body in this embodiment can be appreciated by referring to the structure illustrated in FIGS. 27-31 of the fifth embodiment. The members of the grid structure that meet at the connection node body consist of four upper chord members and four oblique web members. The four upper chord members are respectively connected with the front limb plate, the back limb plate, the left limb plate and the right limb plate at the connection node body. The four oblique web members are respectively connected with the two oblique limb plates at the connection node body. The four upper chord members and the four oblique web members each has either end thereof provided with a connecting groove to receive the respective limb plates at the connection node body and are then fastened together with the respective limb plates using bolts or riveting bolts. The truss structure in this embodiment comprises a plurality of connection nodes, consisting of upper connection nodes and lower connection nodes. Both the upper connection nodes and lower connection nodes involves the use of the connection node body in accordance with this embodiment. The connection node body respectively of an upper connection node and a lower connection node have their installation directions spaced by 180 degrees.

Embodiment 7

Figure 38:
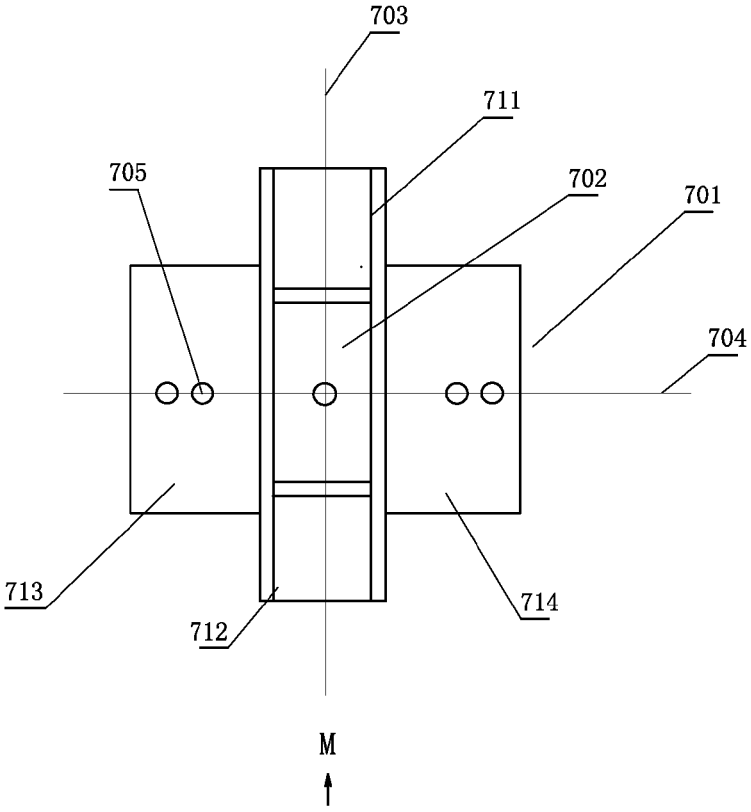
FIG. 38 is a top view of a connection node body in a seventh embodiment.
Figure 39:
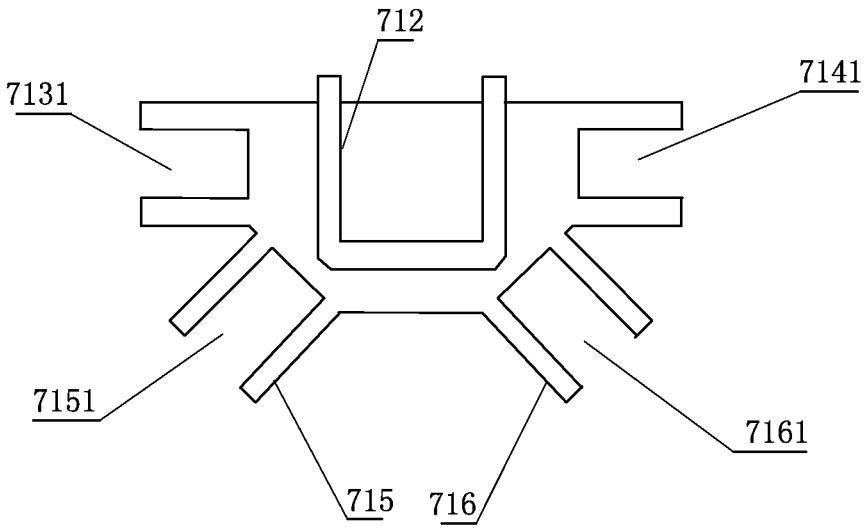
FIG. 39 is a view of FIG. 38 of the seventh embodiment when viewed from M direction.
Figure 40:
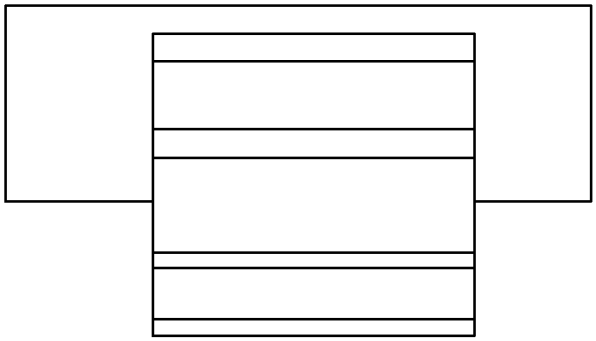
FIG. 40 is a left view of FIG. 39 in the seventh embodiment.

Referring to FIGS. 38-40, the connection node body 701 involved in the square pyramid grid structure in this embodiment comprises a planar base plate 702. A front mortise groove 711 and a back mortise groove 712 are disposed along the extended longitudinal axis 703 of the planar base plate and a left limb plate 713 and a right limb plate 714 are disposed along the extended transverse axis 704 of the planar base plate. Two oblique limb plates 715, 716 are disposed at underside of the planar base plate. The two oblique limb plates are disposed in a splayed manner symmetrically with respect to the longitudinal axis and are parallel to each other. A left mortise groove 7131 parallel to the said longitudinal axis is provided at the end of the left limb plate; a right mortise groove 7141 parallel to the said longitudinal axis is provided at the end of the right limb plate; oblique mortise grooves 7151, 7161 that are parallel to the said longitudinal axis are provided at the end of the respective oblique limb plates. The six mortise grooves each has a bolt hole 705 provided therethrough. Each of the oblique limb plates make an angle of 25-75 degrees with the planar base plate. The prior-art square pyramid grid structure is known to those skilled in the art and will not be described in detail herein.

The application of the connection node body in this embodiment can be appreciated by referring to the structure illustrated in FIG. 28 and FIGS. 32-34 of the fifth embodiment. The members of the grid structure that meet at the connection node body consist of four upper chord members and four oblique web members. The four upper chord members are respectively connected with the front mortise groove, the back mortise groove, the left mortise groove and the right mortise groove at the connection node body. The four oblique web members are respectively connected with the two oblique mortise grooves at the connection node body. The four upper chord members and the four oblique web members each has either end thereof provided with a tenon which is to be implanted into the respective mortise groove and are then fastened together with the connection node body using bolts or riveting bolts. The truss structure in this embodiment comprises a plurality of connection nodes, consisting of upper connection nodes and lower connection nodes. Both the upper connection nodes and lower connection nodes involves the use of the connection node body in accordance with this embodiment. The connection node body respectively of an upper connection node and a lower connection node have their installation directions spaced by 180 degrees.

People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An aluminum alloy truss structure, comprising:

a plurality of aluminum alloy chord members side-by-side arranged along a longitudinal direction of the aluminum alloy truss structure; and a plurality of aluminum alloy web members;

wherein each of the aluminum alloy chord members contains a plurality of connection nodes integrally formed with the aluminum alloy chord member and arranged along a longitudinal direction of the aluminum alloy chord member, each of the connection nodes includes a first connecting unit and a second connecting unit integrally formed with the aluminum alloy chord member, and the first connecting unit is independent of and not connected to the second connecting unit, wherein the first connecting units of the plurality of connection nodes in one aluminum alloy chord member lay in a first plane and the second connecting units of the plurality of connection nodes in said one aluminum alloy chord member lay in a second plane, both the first plane and the second plane are parallel with the longitudinal direction of said one aluminum alloy chord member and there is an angle between the first plane and the second plane;

wherein two ends of each of the aluminum alloy web members are provided with a connecting unit integrally formed with the aluminum alloy web member, respectively, for connecting with the first and second connecting units of the plurality of aluminum alloy chord members, at least some of the first connecting units of the plurality of connection nodes or at least some of the second connecting units of the plurality of connection nodes each connects to two of the aluminum alloy web members, and two aluminum alloy web members connected to the same first connecting unit or second connecting unit lay in the first plane or the second plane and form an angle with each other, whereby the plurality of aluminum alloy chord members are connected to each other by the plurality of aluminum alloy web members;

wherein each of the first connecting units is formed by a first tenon or two parallel first plates forming a first mortise groove therebetween, each of the second connecting units is formed by a second tenon or two parallel second plates forming a second mortise therebetween; each of the connecting units of the aluminum alloy web members includes a mortise groove that mates with the first and second tenon, or a tenon that mates with the first and second mortise groove; when assembled, the first and second tenon is inserted into a corresponding mortise groove of the connecting units of the aluminum alloy web members, respectively, or the tenon of the connecting units of the aluminum alloy web members is inserted into a corresponding first or second mortise groove, and fixedly fastened with bolts or riveting bolts.

2. The aluminum alloy truss structure according to claim 1, wherein there are three aluminum alloy chord members side-by-side arranged along a longitudinal direction of the aluminum alloy truss structure, the angle between the first plane and the second plane is 60°, the aluminum alloy chord members are a hollow pipe with a triangular cross section, and the first connecting units and the second connecting units of the connection nodes are arranged on two longitudinal edges of the hollow pipe.

3. The aluminum alloy truss structure according to claim 1, wherein there are four aluminum alloy chord members side-by-side arranged along a longitudinal direction of the aluminum alloy truss structure, the angle between the first plane and the second plane is 90°, the aluminum alloy chord members are a hollow pipe with a circular cross section or a square cross section and having an enforcement rib therein, and the first connecting units and the second connecting units of the connection nodes are arranged on outer surface of the hollow pipe along a longitudinal direction.

4. The aluminum alloy truss structure according to claim 1, wherein each of the connecting nodes consists of the first tenon and the second tenon.

5. The aluminum alloy truss structure according to claim 1, wherein each of the connecting nodes consists of the two parallel first plates forming the first mortise groove therebetween and the two parallel second plates forming the second mortise groove therebetween.

* * * * *